United States Patent [19]

Hüsemann et al.

[11] 4,099,388

[45] Jul. 11, 1978

[54] DRIVE SHIELD FOR TUNNELING APPARATUS AND A METHOD FOR OPERATING SUCH A SHIELD

[75] Inventors: Heinz Hüsemann; Herbert Heitkamp, both of Werne, Fed. Rep. of Germany

[73] Assignee: Gewerkschaft Eisenhutte Westfalia, Fed. Rep. of Germany

[21] Appl. No.: 733,232

[22] Filed: Oct. 18, 1976

[30] Foreign Application Priority Data

Oct. 18, 1975 [DE] Fed. Rep. of Germany ..... 2546755

[51] Int. Cl.[2] ..... E01G 3/00; E01G 3/02

[52] U.S. Cl. ..... 61/85; 61/42

[58] Field of Search ..... 61/85, 84, 41 A, 42, 61/63; 299/31-33

[56] References Cited

U.S. PATENT DOCUMENTS

| | | | |
|---|---|---|---|
| 1,855,466 | 4/1932 | Barber et al. | 61/85 |
| 3,581,507 | 6/1971 | Stevens | 61/85 |
| 3,864,925 | 2/1975 | Foik | 61/85 X |
| 3,903,707 | 9/1975 | Foik | 61/85 |
| 3,926,005 | 12/1975 | Foik | 61/85 |
| 3,967,454 | 7/1976 | Barnes | 61/41 A |
| 3,998,067 | 12/1976 | Fernandez | 61/85 |

*Primary Examiner*—Dennis L. Taylor

*Attorney, Agent, or Firm*—Thompson, Birch, Gauthier & Samuels

[57] ABSTRACT

A drive shield is formed with a series of drive or cutter members of elongate shape supported in side-by-side relationship around a tunnel wall by a frame and fluid rams are interposed between the frame and the members for effectively relative displacement. To preclude relative movement between the drive members when the frame is shifted by operating all the rams in unison a plurality of locking mechanisms with levers spring-biased into catch plates and effective between neighboring pairs of members ensures all the members lock together when they have all been shifted up by the rams. The levers are released by plates on the frame however when the frame becomes fully drawn up to permit the members to be displaced individually again. Alternatively an analogous hydraulic control system feeds identical flow rates of fluid to the rams when the frame is shifted independent of the prevailing forces or pressure to inhibit relative movement between the drive members.

8 Claims, 5 Drawing Figures

DRIVE SHIELD FOR TUNNELING APPARATUS AND A METHOD FOR OPERATING SUCH A SHIELD

BACKGROUND TO THE INVENTION

The present invention relates to a drive shield for use in tunnel driving and to a method of operating such a shield.

In the driving of tunnels, adits, trenches or the like it is known in the art to use a drive shield composed of elongate drive members or cutter planks arranged side-by-side and supported on a frame structure. Fluid rams are connected between the frame and the drive members and the rams are operated to advance the drive members in the driving direction and then to draw up the frame ready for the next cycle. When the frame is shifted up the drive members provide an anchorage or abutment for the shifting forces. When the conditions allow slippage between the surrounding wall and the members there can be problems when the frame is shifted and ideally all the members should remain in tight frictional contact with the wall when the frame is shifted. There is, however, inevitably a significant difference between the frictional resistance encountered by the drive members in the upper region of the shield and the frictional resistance encountered by the drive members in the lower region of the shield since the latter members usually carry the weight of the excavating machine or other equipment employed to remove the spoil. This is especially the case where tunnels are excavated at shallow depths. In view of this, certain individual drive members or groups of members can become displaced when the frame is shifted up and this creates serious problems.

To overcome this problem it is known to provide anchoring devices on some of the members. These anchoring devices then grip the wall to prevent the slippage of the member in question. These measures are somewhat costly since the devices need to be selectively operated to release or grip the wall and moreover these measures are not fully effective in overcoming the problems discussed.

A general object of this invention is to provide an improved drive shield and method of operating the same.

SUMMARY OF THE INVENTION

In one aspect the invention provides a drive shield for use in tunnel driving; said drive shield being composed of a plurality of elongate drive members arranged side-by-side in parallel relationship, a frame supporting the drive members for individual longitudinal displacement, fluid rams connected between the frame and the drive members and operable to advance the drive members in successive stages and to shift up the frame when the drive members have all been advanced and means for inhibiting relative movement between the members when the frame is being shifted by the rams.

In another aspect the invention provides a method of operating a drive shield composed of a plurality of elongate drive members arranged side-by-side and supported for individual longitudinal displacement on a frame; said method comprising actuating fluid rams to successively advance the drive members in relation to the frame, actuating the fluid rams to draw up the frame towards the advanced members and utilizing means to inhibit relative movement between the members when the frame is being drawn up.

One form of embodiment of the invention employs a mechanical means which selectively locks all the drive members together into a rigid shell when the frame is shifted up by the rams. Another form of embodiment of the invention employs hydraulic means which acts to effectively distribute the reactive forces produced by shifting up the frame to the members to ensure relative movement between the members is inhibited or at least minimized. In either case it is notable that the means can be constructed to function entirely automatically.

In one specific embodiment of the invention the mechanical interlocking means may comprise individual locking mechanisms which lock adjacent drive members together as they become fully advanced in a successive manner. It is here necessary to provide some form of release mechanism to free the members for individual or group advancement when the frame has been completely shifted up. The locking mechanisms can each be in the form of a spring-biased pivotable lever and an associated catch plate on each adjacent pair of drive members. The catch plates may each have a recess for holding its associated lever captive and a guide face which guides the lever into the recess under the action of the spring force when the member carrying the lever moves up towards its fully advanced position. The release mechanism can then be plates which are designed to engage on the levers and release them from their catch plates when the frame is fully shifted. Thus each member would become automatically locked to its neighbouring previously-advanced member when the member itself becomes fully advanced by operation of one of the locking mechanisms. When all the members are advanced they will thus all be interlocked together into a rigid shell able to take up the reactive forces when the frame follows up. When the frame is fully shifted however, the levers are released by the release mechanism rendering the members ready for their next advancing cycle.

The hydraulic means for inhibiting relative movement between the members can act to control the pressure fluid flow when the frame is shifted by the rams. In one simple form the hydraulic means may consist of valves which apportion fluid to feed the same quantity of fluid to each ram per unit time regardless of the pressure or force prevailing when the frame is shifted. Flow splitting valves can be used for this purpose in the return lines of the rams effective during frame shifting. Where relatively large drive shields are involved there may be several pumps supplying the fluid and here each pump can feed a further flow-splitting valve.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
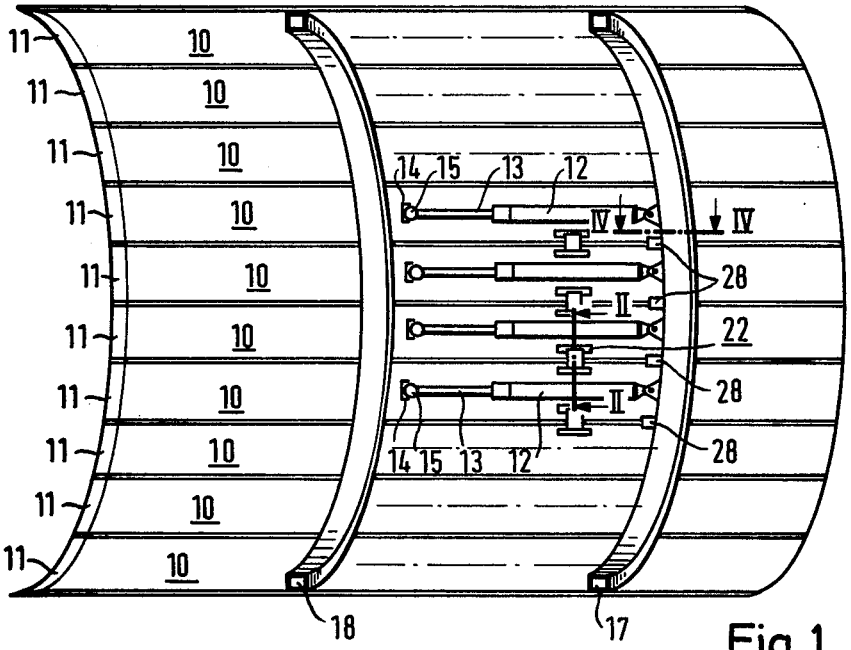
FIG. 1 is a diagrammatical representation of part of a drive shield made in accordance with the invention.

Referring initially to FIG. 1, a drive shield of a tunnelling apparatus is composed, in known manner, of a plurality of elongate members or planks 10 arranged side-by-side in mutually parallel configuration and around the longitudinal axis of the tunnel. The members 10 are formed with cutting edges 11 at their forward ends adjacent the working face of the tunnel from which material is removed to effect advancement of the tunnel. The members 10 are guided for longitudinal movement on two ring-like interconnected components 17, 18 which are spaced apart axially, i.e. in the advancing direction, and which form a frame supporting the members 10 in a position adjacent the defining wall of the tunnel.

The members 10 are urged forwardly to penetrate the working face, either individually or in groups, with the aid of double-acting hydraulic rams. In the example of a shield as illustrated each member 10 is provided with its own hydraulic ram, denoted 12. Each of these rams 12 is located between the rings 17, 18 and has a piston rod 13 which engages on a support or shoe 14 mounted on the inside of its associated member 10. A swivel or articulation joint 15 is provided between each rod 13 and its support 14. The cylinders of the rams 12 are connected, preferably via further articulated joints to the ring 17 so as to be supported thereby.

Figure 2:
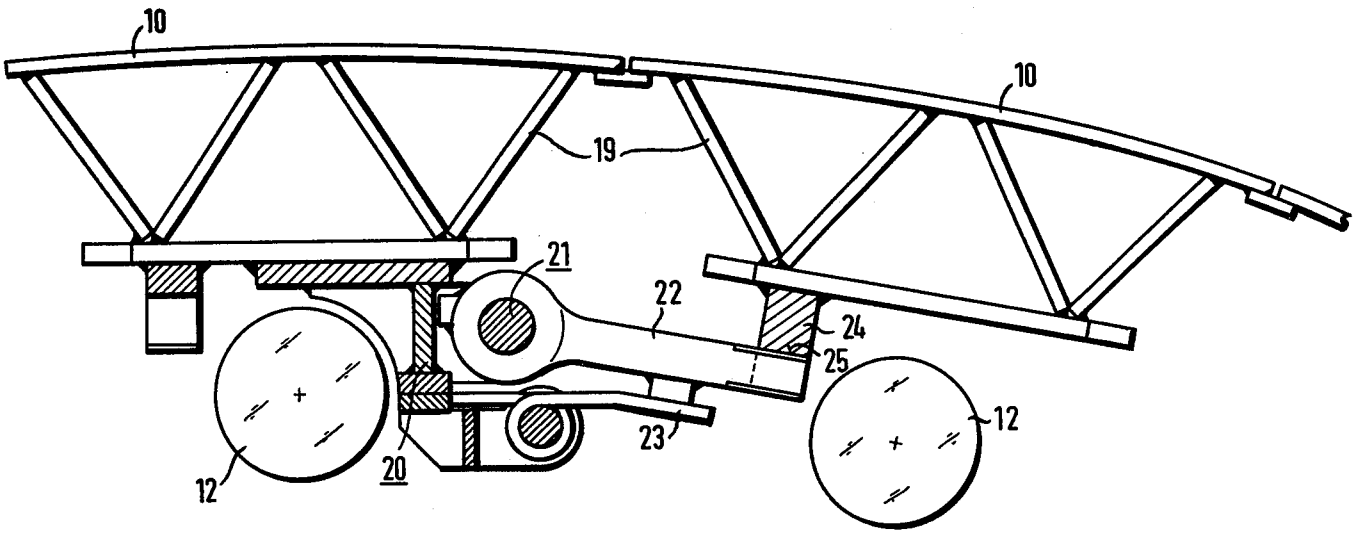
FIG. 2 is a part-sectional end view of part of the shield illustrated in FIG. 1 showing one of the locking mechanisms thereof, the view being taken along the line II—II of FIG. 1 and on a somewhat enlarged scale.
Figure 3:
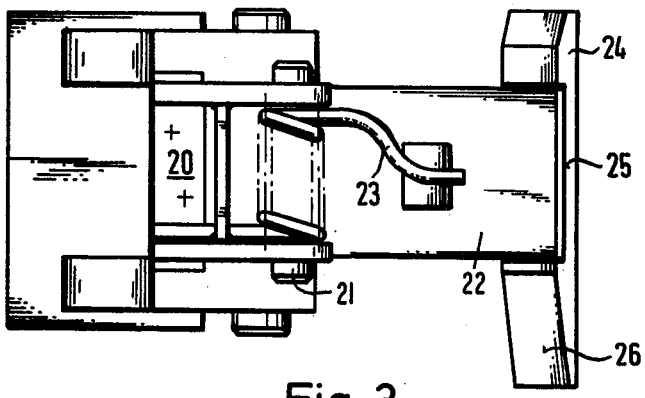
FIG. 3 is a side view of one of the locking mechanisms employed in the drive shield.

In accordance with the invention, interlocking means are provided for the members 10 to lock the members into a rigid shell or casing when the frame 17, 18 is to be drawn up by the rams 12. In the embodiment depicted in FIGS. 1 to 4 the interlocking means takes the form of mechanical locking mechanisms each composed of a lever 22 which is, as shown in FIGS. 2 and 3, mounted for pivoting on a pin 21 supported on a bracket or mounting 20 connected to an associated one of the members 10 through a lattice-like frame 19 or some other structure. The axis of the pin 21 extends parallel to the members 10 and to the central axis of the tunnel.

Figure 4:
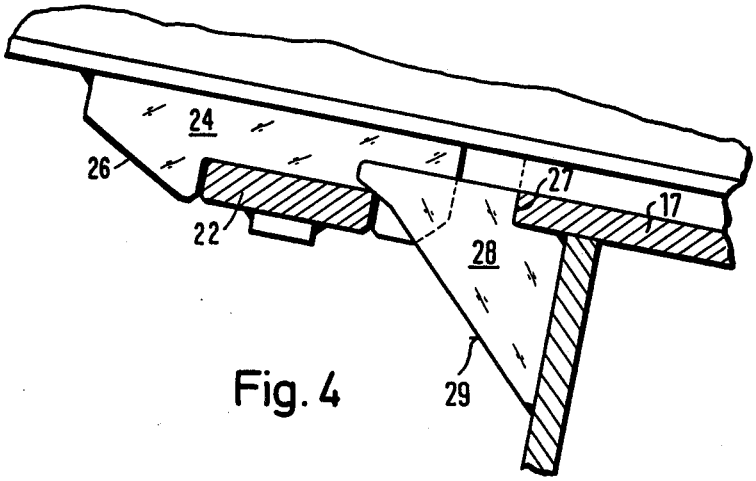
FIG. 4 is a part-sectional plane view of part of the shield illustrated in FIG. 1, the view being taken along the line IV—IV of FIG. 1 and on a somewhat enlarged scale.

As can be seen best in FIG. 2, the lever 22 projects outwardly beyond the adjacent lateral edge of the associated member 10 and is urged or biased outwardly towards the exterior of the member 10, i.e. towards the tunnel wall with the aid of a spring 23 also carried by the mounting 20. The lever 22 is arranged to engage with a catch 24 mounted on frame 19 of the adjacent member 10. Thus each member 10 carries a catch 24 for the lever 22 of one of the adjacent members 10 as well as its own lever 22 as shown at the left hand side of FIG. 2. Each catch 24 takes the form of a flat strip or plate containing a recess 25, adapted to receive the lever 22 associated therewith. As shown in FIG. 3, each catch plate 24 has an inclined face 26 designed to slidably guide the associated lever 22 into the recess 25 for locking under the action of the spring 23. As shown in FIGS. 1 and 4 the ring 17 is provided on its inner side 27 with release elements 28 of triangular plate-like form. Each element 28 has a nose adjoining an inclined face 29 and is located to lie in the inner region between an adjacent pair of members 10. As described hereinafter the elements 28 serve to engage the levers 22 and release them from the recesses 25 in the catch plates 24 at an appropriate stage during the tunnel driving operation and as can be appreciated from FIG. 4.

During operation, the members 10 are thrust forward either individually or in groups and preferably in a set sequence by operating the rams 12. At this phase of the operation the frame 17, 18 remains stationary and serves as an anchorage or abutment and the rear ring 17 takes up the reaction forces of the rams 12 in question. The locking mechanisms 22, 24 interengage successively as one member 10 advances up to the next adjacent one and more particularly the lever 22 of a member 10 which is shifted up to a previously-advanced adjacent member 10 engages on the guide face 26 of the catch plate 24 of the latter member and snaps into the recess 25 under the action of the spring 23. In this way, as the members 10 are shifted they become locked together until finally when all the members 10 are advanced they are interconnected via the locking mechanisms 22, 24 to form a rigid shell. The frame 17, 18 is now shifted by charging all the rams 12 in the reverse sense to draw up the frame 17, 18 along the shell composed of the members 10. During this phase of operation the shell composed of all the members 10 acts as an abutment for the shifting forces by virtue of the combined friction between the tunnel wall and the members 10. Thus even if individual members 10 would be prone to slip because of insufficient frictional resistance to their movement the remainder of the members 10 holds the member 10 in question.

As the ring 17 is moved up the release elements 28 engage with their faces 29 on the levers 22 so that these are lifted from the recesses 25 and the individual members 10 are again free for further advancement to recommence the operative cycle.

Figure 5:
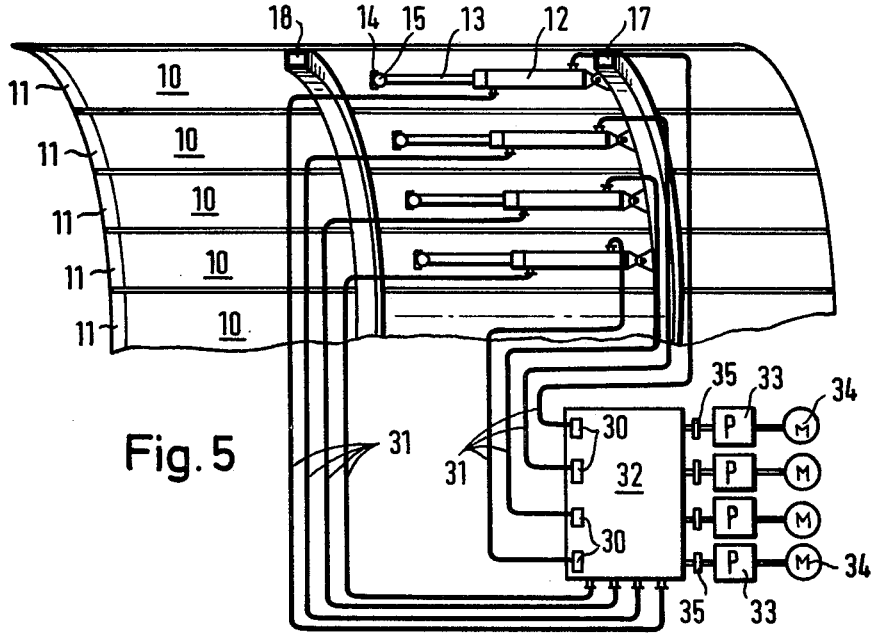
FIG. 5 is a diagrammatical representation of part of a further drive shield made in accordance with the invention.

Instead of employing a mechanical form of locking means such as that described and illustrated in FIGS. 1 to 4 an analogous hydraulic locking means can be employed. An example of one form of hydraulic locking means is represented in FIG. 5 as will now be described. For convenience, like reference numerals are used to denote the common features of the drive shield in FIGS. 1 to 5. In addition FIG. 5 depicts a control station or console 32 for controlling the operation of the fluid operated equipment of the shield. The hydraulic feed and return lines or conduits for the rams 12 are denoted 31 and lead to the station 32. Although a single fluid pump may suffice for smaller shields, where the shield is relatively large however, then a number of pumps 33 as shown in FIG. 5 would be preferable. Each pump 33 is driven by a motor 34 and supplies fluid to a group of rams 12. Control valves 35 are interposed between the pumps 33 and the feed lines 31 for retraction while control valves 30 are connected to the return lines 31 for retraction.

During operation the rams 12 are extended as described to successively advance the members 10 individually or in groups in the manner generally described above. When the members 10 have all been advanced the frame 17, 18 is drawn up by retracting the rams 12. During this action the rams 12 and all operated in unison and the valves 30, 35 ensure that the same quantity of fluid is supplied to and with-drawn from each ram 12 over a set time interval. This regulating function is effective automatically and the apportioned fluid is independent of the prevailing pressure. The reaction forces produced by shifting the frame 17, 18 are distributed and transmitted to the tunnel wall by the members 10 having sufficient frictional contact therewith. Any member 10 which has a somewhat lower frictional resistance viz a viz the tunnel wall takes up a proportionally lower force. In this way any tendency for relative movement to occur between the members 10 is inhibited.

We claim:

1. A drive shield for use in tunnel driving comprising: a plurality of elongate drive members arranged side-by-side in parallel relationship around the tunnel axis; a frame supporting and guiding the members for individual longitudinal displacement; fluid rams coupled between the frame and the drive members and operable to advance the drive members in successive stages and to shift up the frame when the drive members have all been advanced; and automatic means for inhibiting relative movement of the drive members when the frame is being shifted by the rams, the reaction forces produced by the shifting movement being distributed evenly to the drive members.

2. A drive shield according to claim 1, wherein the inhibiting means comprises individual locking mechanisms operable to lock adjacent drive members together as they become fully advanced in a successive manner.

3. A drive shield according to claim 2, wherein there is provided means for releasing the locking mechanisms when the frame has been fully shifted up.

4. A drive shield according to claim 2, wherein each locking mechanism is composed of a spring-biased pivotable lever and an associated catch plate on each adjacent pair of drive members.

5. A drive shield according to claim 4, wherein there is provided means for releasing the locking mechanisms when the frame has been fully shifted up.

6. A drive shield according to claim 5, wherein the release means comprises a plurality of plate-like release elements carried by the frame and serving to engage and release the levers from their catch plates when the frame is fully shifted up.

7. A drive shield according to claim 1, wherein the inhibiting means comprises hydraulic means for controlling the pressure fluid flow when the frame is shifted by the rams.

8. A drive shield according to claim 7, wherein the hydraulic means includes valves for feeding the same quantity of fluid to all the fluid rams per unit time when the frame is shifted up.

* * * * *